United States Patent [19]

Sessum

[11] 4,318,346

[45] Mar. 9, 1982

[54] BIASED TRAVELING CRANE DRIVE

[76] Inventor: Charles E. Sessum, 701 Fleming Ct., Houston, Tex. 77013

[21] Appl. No.: 94,825

[22] Filed: Nov. 16, 1979

[51] Int. Cl.[3] ..... B61B 3/02; B61C 15/04; B61D 15/00; B61F 13/00

[52] U.S. Cl. ..... 105/163 R; 105/73; 105/153

[58] Field of Search ..... 105/153, 163, 73

[56] References Cited

U.S. PATENT DOCUMENTS

| | | | |
|---|---|---|---|
| 2,317,689 | 4/1943 | Medenwald | 105/153 |
| 2,608,163 | 8/1952 | Martin | 105/153 |
| 2,617,365 | 11/1952 | Martin | 105/153 |
| 3,518,947 | 7/1970 | Borst | 105/153 X |
| 3,698,326 | 10/1972 | Schurch et al. | 105/153 X |
| 3,854,406 | 12/1974 | Monne | 105/153 X |

FOREIGN PATENT DOCUMENTS

| | | | |
|---|---|---|---|
| 432859 | 8/1926 | Fed. Rep. of Germany | 105/153 |
| 239422 | 10/1941 | Fed. Rep. of Germany | 105/153 |

*Primary Examiner*—Robert R. Song
*Assistant Examiner*—Howard Beltran
*Attorney, Agent, or Firm*—Kenneth H. Johnson

[57] ABSTRACT

An overhead suspension load transporting trolley which is suspended from a track, such as the flange of an I beam, which has a drive wheel suspended below a carriage, which wheel is biased against the I beam by a counterweight on the opposite end of a lever from the drive wheel.

4 Claims, 4 Drawing Figures

BIASED TRAVELING CRANE DRIVE

BACKGROUND OF THE INVENTION

1. Field of the Invention

The present invention relates to overhead cranes and in particular, to the suspended trolleys used thereon for the transport of a load along the horizontal beam thereof.

2. Prior Art

The present invention relates to both bridge cranes and boom cranes having a horizontal member along which a trolley travels to transport a load. Generally, there are two arrangements or methods for mounting a trolley, one by mounting the trolley on top of the horizontal member or beam and the second of suspending the trolley on wheels or rollers from the horizontal member.

The present invention relates to the latter arrangement. The horizontal member or boom is usually an "I" beam. The trolley is mounted on the lower cross member of beam by wheels which are mounted on the upper surface of the lower cross member or "I" flange. Usually the trolley has four wheels mounted to a frame and various load suspending and lifting means may be mounted to the frame, generally between the wheels or between two such trolleys running on parallel tracks ("I" beams).

The trolley is moved along the beam by a traction drive wheel which is biased against the lower side of the cross member of the beam on which the wheels ride. The prior method of biasing the drive wheel against the beam has employed various arrangements of springs. For example, U.S. Pat. Nos. 3,518,947 and 3,854,406 both show springs urging the wheel support upward. Another arrangement frequently seen in large over head bridge cranes having suspended trolleys is to mount the drive wheel on a lever between a pivot and a tension spring which biases the wheel upward against the I beam.

The spring biased arrangements have been found to cause relatively high wear and require frequent repair. This is particularly true in the spring biased lever arrangement noted above, where the drive wheels have at times worn out in about 24 hours of use. That particular arrangement also is somewhat difficult to service.

It is an advantage of the present invention that the rapid wear experienced with spring biased arrangements has been substantially eliminated and the useful life of the drive wheel extended far beyond that of the prior devices. It is a further advantage of the present invention that servicing and repair are simplified. A particular feature is the elimination of the spring, which is a part of the prior art arrangements. These and other advantages and features will become apparent from the following description and discussion of the invention and its embodiments.

SUMMARY OF THE INVENTION

Briefly, the present invention is a trolley or traction device for load suspension from an overhead crane comprising a carriage mounted on wheels adapted to ride on a flanged beam, a frame having a lever extending from said carriage and below said carriage, said lever being pivotally mounted thereon said lever having a drive wheel mounted toward one end thereof and a counterweight mounted toward the opposite end thereof, said counterweight tending to urge said drive wheel toward said carriage.

The invention may also be viewed as an overhead suspension load transporting trolley to be mounted onto the lower flange of an I beam comprising a carriage having wheels to be mounted on the upper surface of the lower flange of said I beam, a frame extending from said carriage and below said carriage and a drive wheel mounted to said frame and biased to press against the lower surface of said lower flange, wherein the improvement comprises: a lever pivotally mounted to said frame, said drive wheel being mounted thereto toward one end of said lever, a counterweight being mounted toward the other end of said lever, said pivot being between said drive wheel and said counterweight, said counterweight tending to bias said drive wheel against the lower surface of said lower flange.

It is not altogether clear how the present arrangement for biasing the drive wheel against the beam, provides the benefit of reduced wear, although it appears the constant force provided by the counterweight may be at least in part, the reason. Note that the prior spring biased arrangements, do not provide a constant pressure to the wheel. That is, when the spring is compressed or expanded for any reason the actual force of the drive wheel against the beam is increased or decreased. The pressure provided by the spring is constant only at a given expansion or compression thereof, whereas the counterweight always applies the same pressure since for all practical purposes, the effect of gravity is always constant on the counterweight.

Thus, variations in the surface of the flange on which the carriage wheels and the drive wheel ride cause varying pressure on the drive wheel when a spring arrangement is employed. Similarly, the starting and stopping of the trolley in its tasks will change the relative location of the drive wheel to the beam and the flange and hence the pressure on the drive wheel will vary when spring biasing is used. Other factors may have similar or greater effect and the proposed explanation of the improved wear characteristics of the drive wheel according to the present invention is not exclusive of other explanations nor limiting of the invention.

Power to the drive wheel is furnished by conventional means, i.e., drive chain, transmission drive shaft, belts and the like. The motor may be mounted onto the carriage or other portion of the trolley, however, the motor may be employed as the counterweight and mounted onto the lever. It should be appreciated that there may be two or more carriages and drive wheels on a trolley on which the drive wheels may be independently powered or powered from the same source.

DETAILED DESCRIPTION AND PREFERRED EMBODIMENTS

In the following description, elements and members which are duplicates and which perform duplicate functions have been designated with the same number and a single description will apply.

Figure 1:
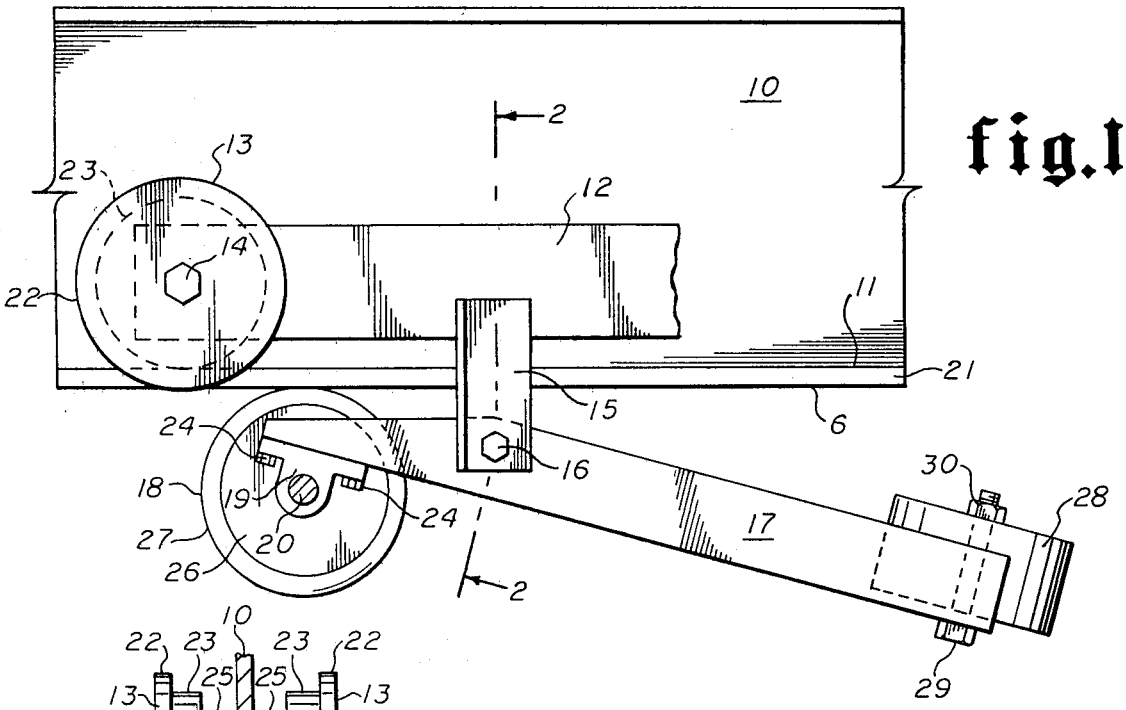
FIG. 1 is a partial elevational view of a trolley according to the present invention.

FIG. 1 is an elevational view showing a trolley according to the present invention seated on an I beam 10. The trolley is composed of a carriage 12 which shows only the one end of the carriage, since the other end is a substantial duplicate of that which is shown and will be described hereafter. Rail wheel 13 is mounted onto the carriage 12 by means of bolt 14 such that the rail wheel is free to rotate about the bolt which serves as an axle. The rail wheel consists of a smaller diameter inner portion 23 shown by the phantom lines which rides on the upper surface 11 of the I beam flange 21, and a larger diameter outer portion 22 which rides along the edge of the lower flange 21. Mounted to the carriage and extending downwardly therefrom, past the lower flange 21 is frame 15.

Figure 2:
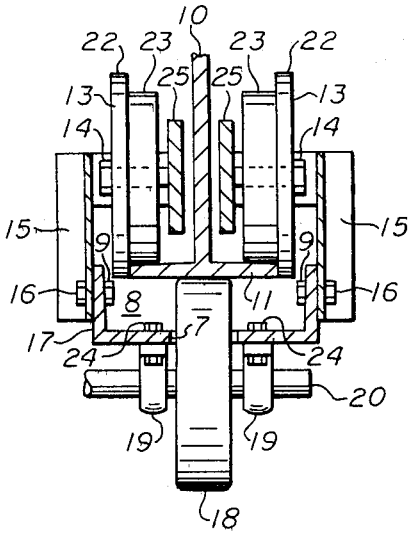
FIG. 2 is a cross sectional view taken along line 2—2 of FIG. 1.

Referring to FIG. 2, it can be seen that the right and left side of the trolley are substantial duplicates comprising a rail wheel 13 mounted to the carriage 12 by means of bolt 14 which terminates in the hub 25. On the both right and left of FIG. 2, the lever 17 is mounted to the frame by bolts 16 and nuts 9. The lever arm 17 being movable about the bolts 16. The lever arm itself is a form of a channel 8 having a slot 7 at one end. Located on either side of slot 7 is a pillow block 19 mounted by bolts 24 to the lever. Drive wheel 18 is mounted on shaft 20 and extends into slot 7 and into contact with the lower flange of the I beam. The drive wheel 18 consists of the wheel 26 and tire 27 mounted thereon. The shaft 20 is connected to a drive means such as an electric motor (not shown).

Referring back to FIG. 1, a counterweight 28 is shown mounted in the channel 8 of the lever by means of a bolt 29 and nut 30. The lever is sufficiently rotatable about the bolts 16 so that the counterweight brings the drive wheel 18 into frictional contact with the lower side 6 of the bottom flange 21 of the I beam. The power is transmitted through the shaft 20 to drive wheel 18. The entire trolley and whatever is connected to it is moved in either direction along the I beam.

Figure 3:
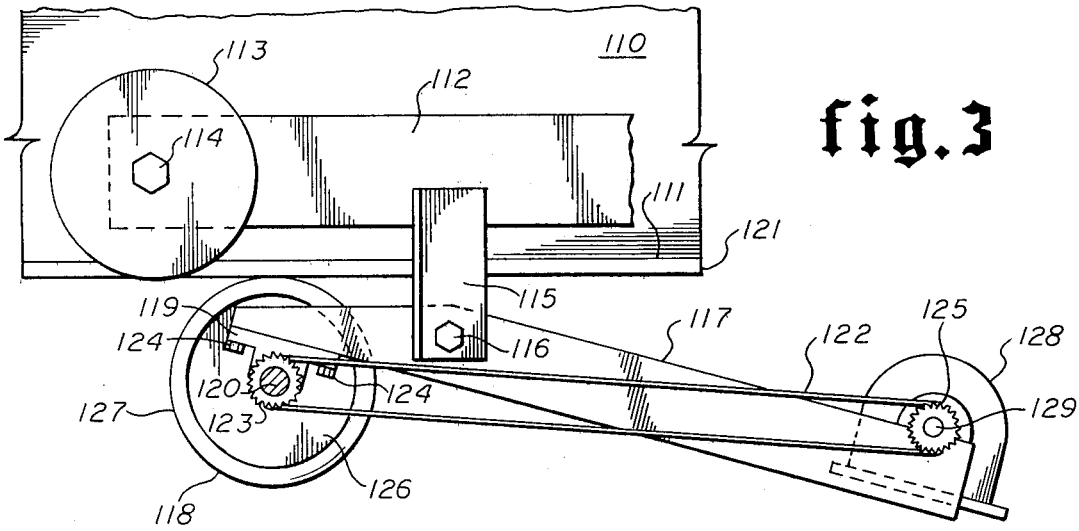
FIG. 3 is a partial elevational view of an alternate embodiment of a trolley according to the present invention.

In FIG. 3 an alternate embodiment is shown wherein a similar carriage 112 is shown having the rail wheel 113 as described above, attached to the carriage by means of bolt 116, with the wheel being freely rotatable about the bolt. Frame 115 is attached to the carriage 112 and extends therefrom downward past the lower flange 121 of I beam 110, with the wheel 113 resting on the upper surface of the lower flange 121 as described in regard to the embodiment in FIG. 1. Mounted to the frame 115 (this embodiment being the same as that shown in FIG. 2 with a duplicate carriage wheel and frame on the side opposed to that shown in FIG. 3) is lever 117 by means of the bolt 116 about which the lever may pivot. Located at one end of the lever is a slot which can not be seen in this configuration but which is described in regard to FIG. 2, and on either side of the slot, is a pillow block bearing 119 mounted to the lever arm and through which shaft 120 extends and on which is mounted the drive wheel 127 which consists of a wheel 126 and a tire 127 mounted thereon. Mounted onto the lever 117 is motor 128 which also serves as a counterweight. The motor 128 is used to drive the drive wheel 118 by means of chain drive 122 which passes around the cog or gear 125 on the motor shaft 129 and cog or gear 123 mounted on the shaft 120 attached to drive wheel 118.

Both the motor 128 in FIG. 3 and the counterweight 28 in FIG. 1 are adjustable in that they may be moved along the lever as is appropriate or additional weight may be added thereto or the weight may be reduced appropriately. Furthermore, the source of power may be any convenient or conventional source such as an electric motor, hydraulic motor, a combination of electric and hydraulic functions or an internal combustion engine or the like.

Figure 4:
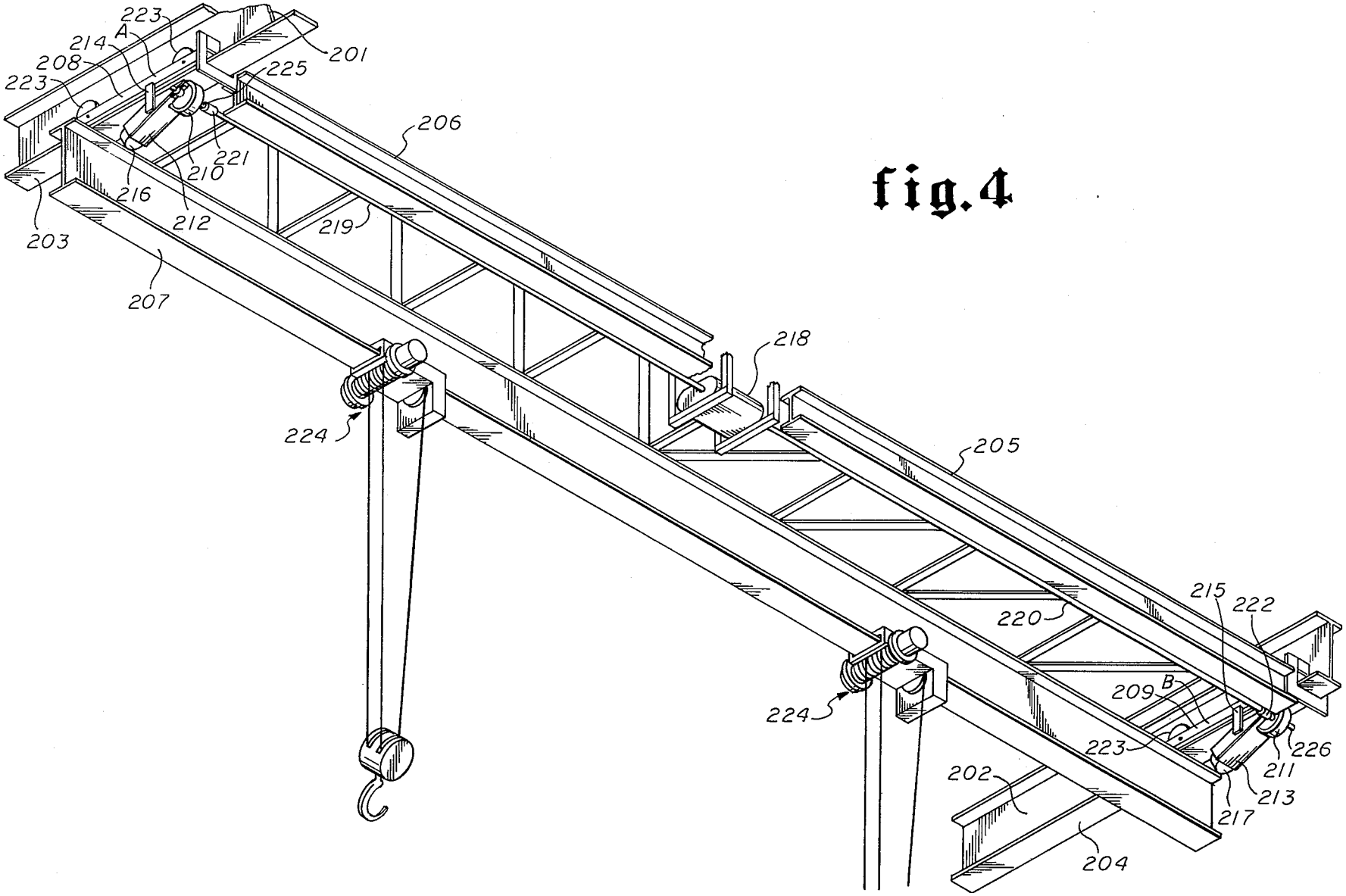
FIG. 4 is a perspective view of a bridge crane employing trolleys according to the present invention.

FIG. 4 shows a perspective view of a bridge crane employing the trolley according to the present invention. Two substantially parallel I beams, 201 and 202 representative of a bridge structure forming the rails upon which the trolley A and B ride respectively are shown. Trolley A consisting of the carriage 208 having wheels 223 mounted fore and aft is shown to be movably mounted onto the lower flange 203 of the I beam. Attached to carriage 208 and extending downward therefrom past the lower flange 203 is frame 214 to which is pivotally mounted the lever 212 at one end of the lever a counterweight 216 is attached and at the other end a drive wheel 210 is movably mounted to the lever and biased against the lower flange 203 by means of the pull of gravity on the counterweight and the rotation of the lever on about the pivot.

On I beam 202, a substantially duplicate trolley B comprising the carriage 209 having wheels 223 (only one showing) mounted thereon is seated on flange 204 on the I beam 202. Attached to carriage 209 and extending downward past flange 204 is frame 215 onto which lever 213 is pivotally mounted. At one end of the lever, a counterweight 217 is mounted at the opposite end past the pivot point, a drive wheel 211 is movably mounted onto the lever and biased by means of the counterweight and the effect of gravity thereon against the lower flange 204.

In this embodiment, both drive wheel 210 and drive wheel 211 are driven from a common source, i.e., in this instance either an engine, electric motor or gear box, 218 by means of shafts 219 and 220 respectively. The drive wheels 210 and 211 being mounted onto axles 225 and 226 respectively, with the axles being connected by flexible couple or universal joints 221 and 222 to the shafts 219 and 220 respectively. The bridge crane itself is composed of a frame 205 which is comprised substantially of two I beams 206 and 207 connected in a conventional manner at each end thereof to the trolleys A and B respectively. The precise structure of the crane is not subject of the present invention and in this instance, the cranes were in existence prior to the present invention, i.e., the trolley having been discovered and applied thereto. Hence, it is considered that that aspect of the disclosure is entirely conventional. Similarly, the hoisting blocks 224 are conventional and are attached to and movable along the I beam 207 by means not shown and they have power means to operate the hoisting of items slung below the crane again by means not shown, but all of the conventional and well known types.

The invention claimed is:

1. A bridge crane for mounting onto two substantially parallel I-beams comprising two trolleys each comprising:

a carriage mounted on wheels adapted to ride on a respective I-beam, a suspension frame extending from each said carriage and below each said carriage having a lever pivotally mounted to each said suspension frame and having a drive wheel mounted to each said lever toward one end thereof and a counterweight mounted toward the opposite end thereof, said counterweight tending to urge said drive wheel toward said carriage at a constant force to provide the only force causing each said drive wheel to engage each said I-beam, a connecting frame connecting said trolleys and a drive means mounted to said connecting frame and operably connected to each drive wheel.

2. The bridge crane according to claim 1 wherein said lever is pivotally mounted between said drive wheel and said counterbalance.

3. The bridge crane load transporting trolley according to claim 1 wherein drive wheels are powered by a common source.

4. The bridge crane load transporting trolley according to claim 3 wherein said common source is connected to said drive wheels by a shaft.

* * * * *